US006997088B2

(12) United States Patent
Hu

(10) Patent No.: US 6,997,088 B2
(45) Date of Patent: Feb. 14, 2006

(54) SCREWDRIVER HEADS CHAMBER FOR A PRECISE SCREWDRIVER

(76) Inventor: Cheng-Tsan Hu, No. 205, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 51 days.

(21) Appl. No.: 10/802,785

(22) Filed: Mar. 18, 2004

(65) Prior Publication Data

US 2005/0204878 A1 Sep. 22, 2005

(51) Int. Cl.
*B25B 23/18* (2006.01)

(52) U.S. Cl. ..... 81/490; 81/177.4; 81/439; 7/127

(58) Field of Classification Search ..... 81/177.4, 81/439, 490, 177.5, 489; 7/127, 165
See application file for complete search history.

(56) References Cited

U.S. PATENT DOCUMENTS 3,426,813 A * 2/1969 Robertson ..... 81/490
4,716,796 A * 1/1988 Corona et al. ..... 81/177.4
4,846,042 A * 7/1989 Wetty ..... 81/490
5,740,706 A * 4/1998 Tseng ..... 81/490
6,151,997 A * 11/2000 Lin ..... 81/177.4
6,305,815 B1 * 10/2001 Lin ..... 362/119

* cited by examiner

*Primary Examiner*—Lee D. Wilson
*Assistant Examiner*—Anthony Ojini
(74) *Attorney, Agent, or Firm*—Rosenberg, Klein & Lee

(57) ABSTRACT

A driver heads barrel for a precise screwdriver includes a handle, a stem, and a cover. The handle has a chamber to accommodate a stem and screwdriver heads therein. A groove is formed close to an outer end of the chamber. A reverse cone-shaped disc is formed at an inner end of the stem. The stem has a plurality of longitudinal partitions thereof. The cover has a barrel extending downwardly from one end. A ridge corresponding to the groove of the chamber is formed on the barrel. The disc of the stem is secured into the inner end of the chamber of the handle. The screwdriver heads are accommodated between the partitions and the chamber. The barrel of the cover is inserted into the chamber with the ridge engaging with the groove. The cover is pivotally connected to the outer end of the chamber of the handle.

2 Claims, 3 Drawing Sheets

A

SCREWDRIVER HEADS CHAMBER FOR A PRECISE SCREWDRIVER

FIELD OF THE INVENTION

This invention relates to a chamber of a screwdriver to accommodate a stem and screwdriver heads in a secure method, and a cover is pivotally connected to an outer end of a handle.

BACKGROUND OF THE INVENTION

There are plenty of screwdrivers on the market. A conventional screwdriver has a chamber in the handle, which has a notch at one side and is covered by a cap. By opening the cap, screwdriver heads in the chamber are free to take away. The screwdriver heads are secured on a shaft, which then are secured on a threaded cap. The shaft is extending through the cap and connected with a knob. By turning the knob, the shaft is turning simultaneously so that a user may choose a desired head. However, in order to pick up the head, the user has to stretch into the notch with their finger, and the cap is in a loose status, which may be lost.

Another conventional screwdriver has a hole at the rear end of a handle with a cover thereon. A screwdriver head can slide out from the hole. There are some shortcomings of this design. One is that the cover may be misplaced easily.

SUMMARY OF THE INVENTION

It is the primary object of the present invention to provide a screwdriver heads chamber for a precise screwdriver, which saves space and is easy to operate.

It is another object of the present invention to provide a screwdriver heads chamber for a precise screwdriver, which secures all screwdriver heads in a chamber of a handle.

It is a further object of the present invention to provide a screwdriver heads chamber for a precise screwdriver, which is inexpensive in manufacture.

DETAILED DESCRIPTION OF THE PREFERRED EMBODIMENT

Figure 1:
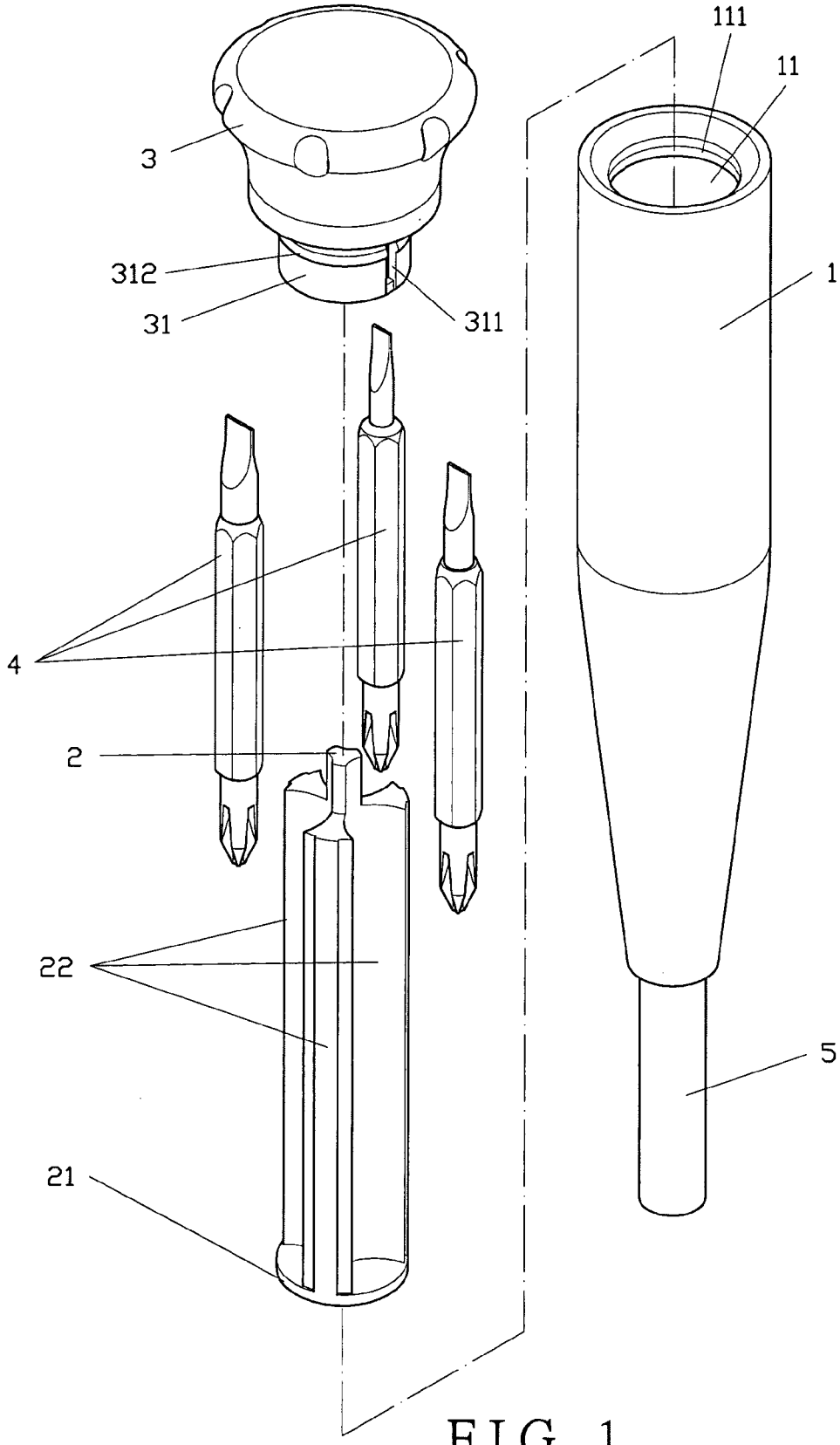
FIG. 1 is an exploded view of the present invention.
Figure 2:
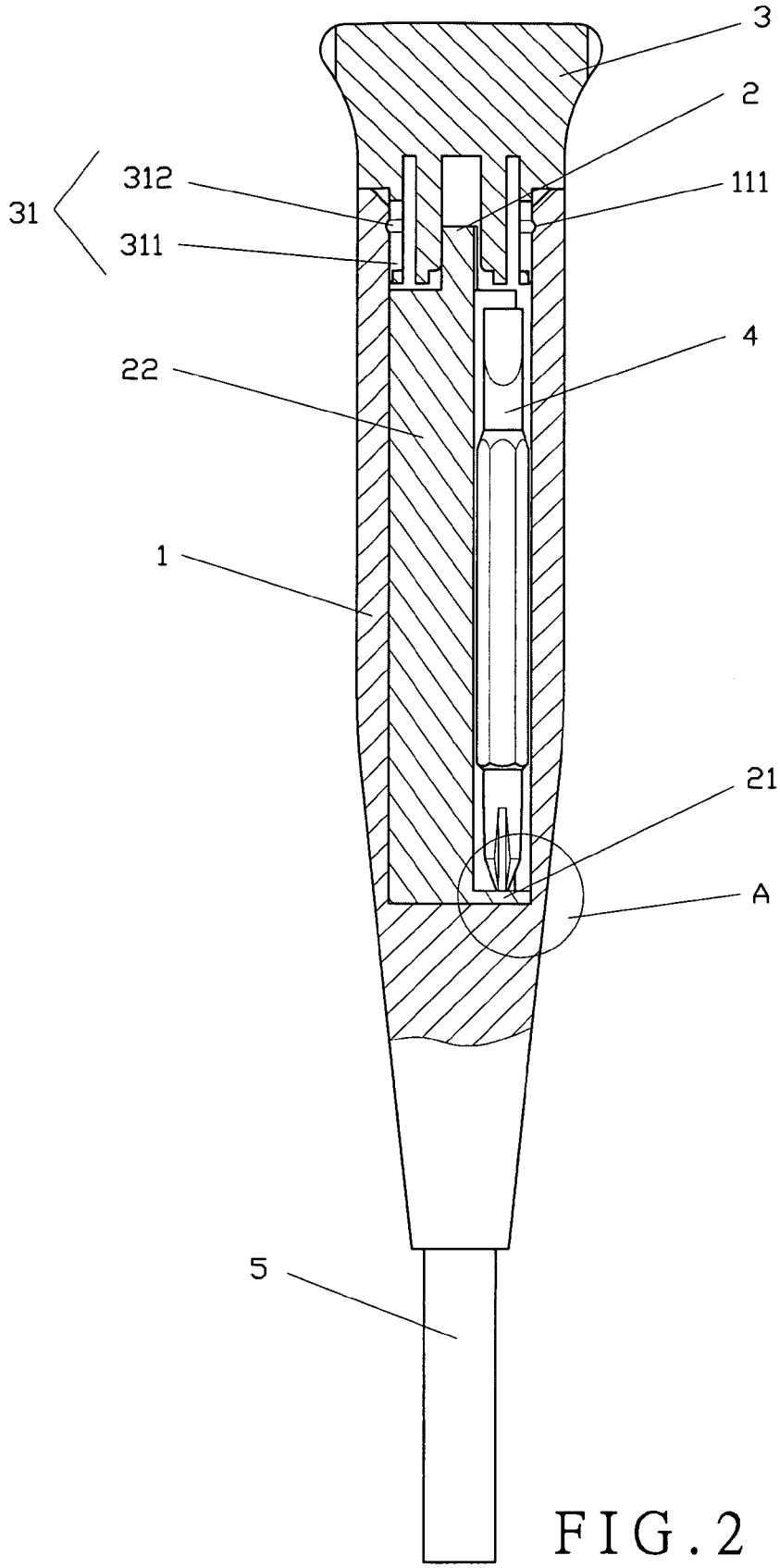
FIG. 2 is a side view of the present invention, partially sectioned.

As shown in FIGS. 1 and 2, the present invention comprises a handle 1, a stem 2 and a cover 3. The handle 1 has an internal chamber 11 to accommodate the stem 2 and screwdriver heads 4. One end of the handle 1 is a driving end 5 while the other end is interconnected with the chamber 11 and pivotally connected to the cover 3.

The chamber 11 is a hollow barrel with an inner end and an outer end. The outer end of the chamber 11 is provided with a groove 111. The stem 2 also has an inner end and an outer end corresponding to the chamber 11 of the handle 1.

The inner end of the stem 2 is in a reverse cone-shaped disc 21. The disc 21 has an outer diameter corresponding to the inner diameter of the inner end of the chamber 11.

The stem 2 comprises a plurality of longitudinal partitions 22. The partitions 22 have an outer diameter that is smaller than the inner diameter of the chamber 11.

The cover 3 has a barrel 31 extending towards one end thereof. The barrel 31 has an outer diameter corresponding to the inner diameter of the chamber 11. A plurality of slots 311 are formed on the barrel 31 to produce a flexibility of the barrel 31. A ridge 312 is formed on the barrel 31 and corresponding to the groove 111 of the chamber 11.

Figure 3:
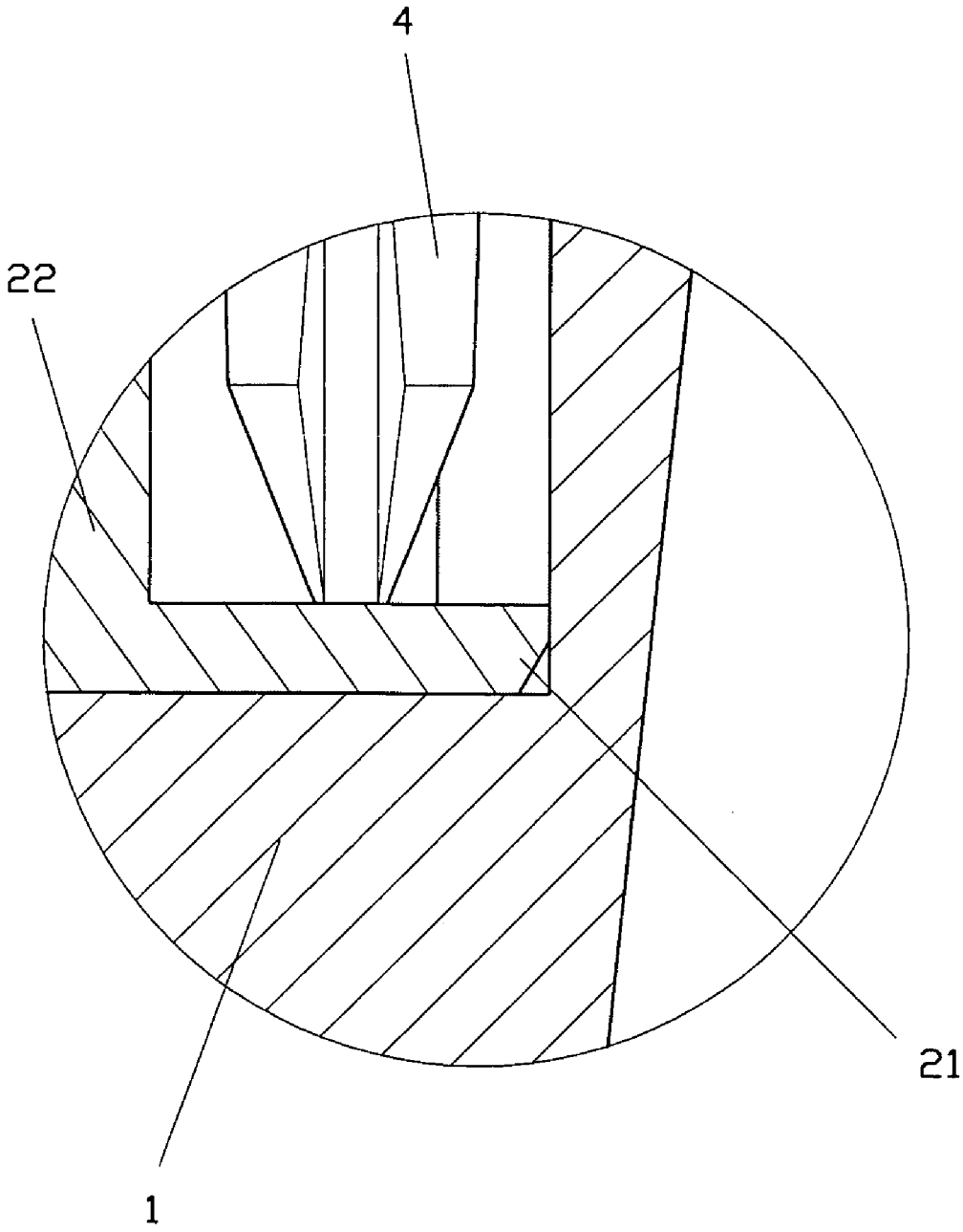
FIG. 3 is an enlarged view of a circle A from FIG. 2.

The disc 21 of the stem 2 is secured into the chamber 11 of the handle 1, as shown in FIGS. 2 and 3. All screwdriver heads 4 are placed in between the partitions 22 of the stew 2 and the chamber 11. The barrel 31 of the cover 3 is inserted into the chamber 11 with the ridge 312 engaging with the groove 111. This secures the cover 3 to the outer end of the chamber 11 of the handle 1. The cover 3 is rotatably coupled to the handle 1, which is not easy to depart from the handle 1.

I claim:

1. A screwdriver heads chamber for a precise screwdriver comprising; a handle, a stem, and a cover, said handle having a hollow chamber to receive said stem and a plurality of screwdriver heads, said handle having two ends, one end being a driving end while another end being interconnected with said chamber and pivotally connected to said cover, said chamber extending in a longitudinal direction and being a hollow barrel with an inner end and an outer end, a groove being formed close to said outer end of said chamber, said stem comprising an inner end and an outer end, a disc being formed at said inner end of said stem, said disc having an outer diameter corresponding to an inner diameter of said inner end of said chamber, said stem comprising a plurality of longitudinal partitions, said partitions having an outer diameter that is slightly smaller than the inner diameter of said chamber, said cover comprising a barrel extending downwardly from one end, said barrel having an outer diameter corresponding to the inner diameter of said chamber, at least one slot being formed on said barrel, a ridge corresponding to said groove of said chamber being formed on said barrel, thus, said disc of said stem being secured into said inner end of said chamber of said handle, said screwdriver heads being accommodated between said partitions and said chamber, said barrel of said cover being inserted into said chamber with said ridge engaging with said groove, said cover being rotatably connected to said outer end of said chamber of said handle, whereby when said cover is removed from said chamber all of said screwdriver heads are accessible for selective longitudinal displacement of a selected screwdriver head.

2. The driver heads chamber for a precise screwdriver, as recited in claim 1, wherein said disc of said stem is in a reversed cone shape.

* * * * *